US010953566B2

(12) United States Patent
Fransson et al.

(10) Patent No.: US 10,953,566 B2
(45) Date of Patent: Mar. 23, 2021

(54) DEVICE FOR INSERTING A TONGUE

(71) Applicant: VALINGE INNOVATION AB, Viken (SE)

(72) Inventors: Jonas Fransson, Allerum (SE); Andreas Blomgren, Ljungskile (SE); Karl Erikson, Uddevalla (SE)

(73) Assignee: VALINGE INNOVATION AB, Viken (SE)

( * ) Notice: Subject to any disclaimer, the term of this patent is extended or adjusted under 35 U.S.C. 154(b) by 425 days.

(21) Appl. No.: 15/848,164

(22) Filed: Dec. 20, 2017

(65) Prior Publication Data

US 2018/0178406 A1 Jun. 28, 2018

(30) Foreign Application Priority Data

Dec. 22, 2016 (SE) ..... 1651731-0

(51) Int. Cl.
*B25B 27/02* (2006.01)
*B27M 3/00* (2006.01)
(Continued)

(52) U.S. Cl.
CPC ..... *B27M 3/0066* (2013.01); *B25B 27/02* (2013.01); *B27M 3/18* (2013.01); *B27M 3/04* (2013.01);
(Continued)

(58) Field of Classification Search
CPC ..... B27M 3/0066; B27M 3/18; B27M 3/04; B25B 27/02; E04F 15/02; E04F 2201/0523
See application file for complete search history.

(56) References Cited

U.S. PATENT DOCUMENTS 1,194,636 A 8/1916 Joy
1,687,522 A 10/1928 Staude
(Continued)

FOREIGN PATENT DOCUMENTS

BE 1 020 211 A5 6/2010
BE 1 019 989 a3 3/2013
BR PI 0906645-4 A2 9/2009
DE 25 05 489 A1 6/1976
(Continued)

OTHER PUBLICATIONS

U.S. Appl. No. 16/311,224, Jonas Fransson and Anders Aldsten, filed Dec. 19, 2018 (Cited herein as US Patent Application Publication No. 2019/0232473 A1 of Aug. 1, 2019).
(Continued)

*Primary Examiner* — Rick K Chang
(74) *Attorney, Agent, or Firm* — Buchanan Ingersoll & Rooney P.C.

(57) ABSTRACT

A handheld device is disclosed for inserting a tongue into an insertion groove in a panel. The device includes a first part including a power unit which is configured for driving a puncher. The handheld device includes a second part, which is connected to the first part. The second part includes the displaceable puncher and a guiding device which is configured to guide the displaceable puncher and the tongue. An outer edge of the second part includes a first positioning element and a second positioning element. The first positioning element and the second positioning element are configured to be positioned at least partly in the insertion groove during an insertion of the tongue into the insertion groove. The displaceable puncher is configured to displace the tongue from the handheld device to an inserted position in the insertion groove.

8 Claims, 9 Drawing Sheets

(51) Int. Cl.
*B27M 3/18* (2006.01)
*B27M 3/04* (2006.01)
*E04F 15/02* (2006.01)

(52) U.S. Cl.
CPC ..... *E04F 15/02* (2013.01); *E04F 2201/0523* (2013.01)

(56) References Cited

U.S. PATENT DOCUMENTS 1,902,716 A 3/1933 Newton
3,114,477 A 12/1963 Dixon
3,143,335 A 8/1964 Lassahn
3,147,522 A 9/1964 Schumm
3,381,730 A 5/1968 Omholt
3,572,224 A 3/1971 Perry
3,579,941 A 5/1971 Tibbals
3,584,761 A 6/1971 Flanigan et al.
3,720,027 A 3/1973 Christensen
3,760,485 A 9/1973 Smith
3,760,547 A 9/1973 Brenneman
3,778,954 A 12/1973 Meserole
3,919,820 A 11/1975 Green
3,930,808 A 1/1976 Miller et al.
3,961,408 A 6/1976 Goodsmith
4,098,173 A 7/1978 Schauman
4,332,203 A 6/1982 Flowers
4,648,165 A 3/1987 Whitehorne
4,899,438 A 2/1990 Muller et al.
5,105,980 A 4/1992 Hofmann
5,174,022 A 12/1992 Phillips et al.
5,388,721 A 2/1995 Mauer
5,582,611 A 12/1996 Tsuruta et al.
5,636,426 A 6/1997 Luckhardt et al.
5,810,239 A * 9/1998 Stich ..... B25C 7/00 227/119
5,996,876 A 12/1999 Dickhoff et al.
6,098,442 A 8/2000 Walldorf et al.
6,273,315 B1 8/2001 McGuinness et al.
6,314,701 B1 11/2001 Meyerson
6,363,677 B1 4/2002 Chen et al.
6,385,936 B1 5/2002 Schneider
6,413,007 B1 7/2002 Lambright
6,418,683 B1 7/2002 Martensson et al.
6,446,413 B1 9/2002 Gruber
6,490,836 B1 12/2002 Moriau et al.
6,505,452 B1 1/2003 Hannig
6,592,015 B1 7/2003 Gostylla et al.
6,631,827 B2 10/2003 Goodsmith
6,647,690 B1 11/2003 Martensson
6,651,400 B1 11/2003 Murphy
6,655,573 B1 12/2003 Chang
6,763,643 B1 7/2004 Martensson
6,766,622 B1 7/2004 Thiers
6,769,835 B2 8/2004 Stridsman
6,804,926 B1 10/2004 Eisermann
6,807,719 B2 10/2004 Herr et al.
6,843,402 B2 1/2005 Sims et al.
6,854,235 B2 2/2005 Martensson
6,880,307 B2 4/2005 Schwitte et al.
7,040,068 B2 5/2006 Moriau et al.
7,051,486 B2 5/2006 Pervan
7,188,456 B2 3/2007 Knauseder
7,255,256 B2 8/2007 McGee et al.
7,344,057 B2 3/2008 Dion et al.
7,451,578 B2 11/2008 Hannig
7,454,875 B2 11/2008 Pervan et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,896,571 B1 3/2011 Hannig et al.
7,908,815 B2 3/2011 Pervan et al.
7,908,816 B2 3/2011 Grafenauer
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,061,248 B2 11/2011 Svensson
8,079,196 B2 12/2011 Pervan
8,091,238 B2 1/2012 Hannig
8,112,967 B2 2/2012 Pervan et al.
8,171,692 B2 5/2012 Pervan
8,181,416 B2 5/2012 Pervan et al.
8,234,830 B2 8/2012 Pervan et al.
8,256,104 B2 9/2012 Fulbright
8,302,367 B2 11/2012 Schulte
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,738 B2 2/2014 Schulte
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,340 B2 7/2014 Pervan et al.
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,120,141 B2 9/2015 Clew et al.
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan et al.
9,382,716 B2 7/2016 Pervan et al.

(56) References Cited

U.S. PATENT DOCUMENTS

| | | | |
|---|---|---|---|
| 9,388,584 | B2 | 7/2016 | Pervan et al. |
| 9,428,919 | B2 | 8/2016 | Pervan et al. |
| 9,453,347 | B2 | 9/2016 | Pervan et al. |
| 9,458,634 | B2 | 10/2016 | Derelov |
| 9,482,012 | B2 | 11/2016 | Nygren et al. |
| 9,540,826 | B2 | 1/2017 | Pervan et al. |
| 9,555,529 | B2 | 1/2017 | Ronconi |
| 9,663,940 | B2 | 5/2017 | Boo |
| 9,725,912 | B2 | 8/2017 | Pervan |
| 9,771,723 | B2 | 9/2017 | Pervan |
| 9,777,487 | B2 | 10/2017 | Pervan et al. |
| 9,803,374 | B2 | 10/2017 | Pervan |
| 9,803,375 | B2 | 10/2017 | Pervan |
| 9,856,656 | B2 | 1/2018 | Pervan |
| 9,874,027 | B2 | 1/2018 | Pervan |
| 9,945,130 | B2 | 4/2018 | Nygren et al. |
| 9,951,526 | B2 | 4/2018 | Boo et al. |
| 10,006,210 | B2 | 6/2018 | Pervan et al. |
| 10,017,948 | B2 | 7/2018 | Boo |
| 10,113,319 | B2 | 10/2018 | Pervan |
| 10,125,488 | B2 | 11/2018 | Boo |
| 10,138,636 | B2 | 11/2018 | Pervan |
| 10,161,139 | B2 | 12/2018 | Pervan |
| 10,180,005 | B2 | 1/2019 | Pervan et al. |
| 10,214,915 | B2 | 2/2019 | Pervan et al. |
| 10,214,917 | B2 | 2/2019 | Pervan et al. |
| 10,240,348 | B2 | 3/2019 | Pervan et al. |
| 10,240,349 | B2 | 3/2019 | Pervan et al. |
| 10,246,883 | B2 | 4/2019 | Derelöv |
| 10,307,815 | B2 | 6/2019 | Badent et al. |
| 10,352,049 | B2 | 7/2019 | Boo |
| 10,358,830 | B2 | 7/2019 | Pervan |
| 10,378,217 | B2 | 8/2019 | Pervan |
| 10,458,125 | B2 | 10/2019 | Pervan |
| 10,526,792 | B2 | 1/2020 | Pervan et al. |
| 10,538,922 | B2 | 1/2020 | Pervan |
| 10,570,625 | B2 | 2/2020 | Pervan |
| 10,640,989 | B2 | 5/2020 | Pervan |
| 10,655,339 | B2 | 5/2020 | Pervan |
| 10,669,723 | B2 | 6/2020 | Pervan et al. |
| 10,724,251 | B2 | 7/2020 | Kell |
| 10,731,358 | B2 | 8/2020 | Pervan |
| 10,828,798 | B2 | 11/2020 | Fransson |
| 2002/0031646 | A1 | 3/2002 | Chen et al. |
| 2002/0170259 | A1 | 11/2002 | Ferris |
| 2002/0178674 | A1 | 12/2002 | Pervan |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0016196 | A1 | 1/2004 | Pervan |
| 2004/0031227 | A1 | 2/2004 | Knauseder |
| 2004/0060255 | A1 | 4/2004 | Knauseder |
| 2004/0068954 | A1 | 4/2004 | Martensson |
| 2004/0123548 | A1 | 7/2004 | Gimpel et al. |
| 2004/0128934 | A1 | 7/2004 | Hecht |
| 2004/0200175 | A1 | 10/2004 | Weber |
| 2004/0211143 | A1 | 10/2004 | Hannig |
| 2004/0244325 | A1 | 12/2004 | Nelson |
| 2004/0261348 | A1 | 12/2004 | Vulin |
| 2005/0081373 | A1 | 4/2005 | Seidler |
| 2005/0160694 | A1 | 7/2005 | Pervan |
| 2005/0205161 | A1 | 9/2005 | Lewark |
| 2005/0210810 | A1 | 9/2005 | Pervan |
| 2006/0070333 | A1 | 4/2006 | Pervan |
| 2006/0101769 | A1 | 5/2006 | Pervan |
| 2006/0162814 | A1 | 7/2006 | Symossek et al. |
| 2006/0236642 | A1 | 10/2006 | Pervan |
| 2006/0260254 | A1 | 11/2006 | Pervan et al. |
| 2007/0006543 | A1 | 1/2007 | Engström |
| 2007/0011981 | A1 | 1/2007 | Eisermann |
| 2007/0028547 | A1 | 2/2007 | Grafenauer |
| 2007/0151189 | A1 | 7/2007 | Yang et al. |
| 2007/0175156 | A1 | 8/2007 | Pervan et al. |
| 2007/0193178 | A1 | 8/2007 | Groeke et al. |
| 2008/0000186 | A1 | 1/2008 | Pervan et al. |
| 2008/0000187 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan |
| 2008/0068415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan |
| 2008/0134613 | A1 | 6/2008 | Pervan |
| 2008/0134614 | A1 | 6/2008 | Pervan |
| 2008/0155930 | A1 | 7/2008 | Pervan et al. |
| 2008/0216434 | A1 | 9/2008 | Pervan |
| 2008/0216920 | A1 | 9/2008 | Pervan |
| 2008/0295432 | A1 | 12/2008 | Pervan et al. |
| 2009/0133353 | A1 | 5/2009 | Pervan et al. |
| 2009/0193748 | A1 | 8/2009 | Boo et al. |
| 2010/0043333 | A1 | 2/2010 | Hannig et al. |
| 2010/0218360 | A1 | 9/2010 | Mangone, Jr. |
| 2010/0293879 | A1 | 11/2010 | Pervan et al. |
| 2010/0300031 | A1 | 12/2010 | Pervan et al. |
| 2010/0313714 | A1 | 12/2010 | Smith |
| 2010/0319290 | A1 | 12/2010 | Pervan |
| 2010/0319291 | A1 | 12/2010 | Pervan et al. |
| 2011/0030303 | A1 | 2/2011 | Pervan et al. |
| 2011/0041996 | A1 | 2/2011 | Pervan |
| 2011/0088344 | A1 | 4/2011 | Pervan et al. |
| 2011/0088345 | A1 | 4/2011 | Pervan |
| 2011/0088346 | A1 | 4/2011 | Hannig |
| 2011/0094083 | A1 | 4/2011 | Schulte |
| 2011/0154763 | A1 | 6/2011 | Bergelin et al. |
| 2011/0167750 | A1 | 7/2011 | Pervan |
| 2011/0167751 | A1 | 7/2011 | Engstrom |
| 2011/0225922 | A1 | 9/2011 | Pervan et al. |
| 2011/0252733 | A1 | 10/2011 | Pervan |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0073235 | A1 | 3/2012 | Hannig |
| 2012/0151865 | A1 | 6/2012 | Pervan et al. |
| 2012/0174515 | A1 | 7/2012 | Pervan et al. |
| 2012/0174520 | A1 | 7/2012 | Pervan |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0019555 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan et al. |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160391 | A1 | 6/2013 | Pervan et al. |
| 2013/0232905 | A2 | 9/2013 | Pervan |
| 2013/0239508 | A1 | 9/2013 | Pervan et al. |
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0033634 | A1 | 2/2014 | Pervan |
| 2014/0042203 | A1 | 2/2014 | Abe |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Pervan |
| 2014/0109506 | A1 | 4/2014 | Pervan et al. |
| 2014/0123586 | A1 | 5/2014 | Pervan et al. |
| 2014/0138422 | A1 | 5/2014 | Ronconi |
| 2014/0150369 | A1 | 6/2014 | Hannig |

(56) References Cited

U.S. PATENT DOCUMENTS

| | | | |
|---|---|---|---|
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0260060 | A1 | 9/2014 | Pervan et al. |
| 2014/0305065 | A1 | 10/2014 | Pervan |
| 2014/0338177 | A1 | 11/2014 | Vermeulen et al. |
| 2014/0366476 | A1 | 12/2014 | Pervan |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0059281 | A1 | 3/2015 | Pervan |
| 2015/0078819 | A1 | 3/2015 | Derelöv et al. |
| 2015/0089896 | A2 | 4/2015 | Pervan et al. |
| 2015/0121796 | A1 | 5/2015 | Pervan |
| 2015/0152644 | A1 | 6/2015 | Boo |
| 2015/0167318 | A1 | 6/2015 | Pervan |
| 2015/0194884 | A1 | 7/2015 | Pervan et al. |
| 2015/0211239 | A1 | 7/2015 | Pervan |
| 2015/0233125 | A1 | 8/2015 | Pervan et al. |
| 2015/0267419 | A1 | 9/2015 | Pervan |
| 2015/0300029 | A1 | 10/2015 | Pervan |
| 2015/0321325 | A1 | 11/2015 | Vandenberg |
| 2015/0330088 | A1 | 11/2015 | Derelov |
| 2015/0336224 | A1 | 11/2015 | Liu et al. |
| 2015/0337537 | A1 | 11/2015 | Boo |
| 2016/0032596 | A1 | 2/2016 | Nygren et al. |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |
| 2016/0129573 | A1 | 5/2016 | Anstett et al. |
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0037641 | A1 | 2/2017 | Nygren et al. |
| 2017/0081860 | A1 | 3/2017 | Boo |
| 2017/0254096 | A1 | 9/2017 | Pervan |
| 2017/0321433 | A1 | 11/2017 | Pervan et al. |
| 2017/0362834 | A1 | 12/2017 | Pervan et al. |
| 2018/0001509 | A1 | 1/2018 | Myllykangas et al. |
| 2018/0001510 | A1 | 1/2018 | Fransson |
| 2018/0001573 | A1 | 1/2018 | Blomgren et al. |
| 2018/0002933 | A1 | 1/2018 | Pervan |
| 2018/0030737 | A1 | 2/2018 | Pervan |
| 2018/0030738 | A1 | 2/2018 | Pervan |
| 2018/0119431 | A1 | 5/2018 | Pervan et al. |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0119928 | A1 | 4/2019 | Pervan et al. |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0232473 | A1 | 8/2019 | Fransson et al. |
| 2019/0271165 | A1 | 9/2019 | Boo |
| 2019/0376298 | A1 | 12/2019 | Pervan et al. |
| 2019/0394314 | A1 | 12/2019 | Pervan et al. |
| 2020/0087927 | A1 | 3/2020 | Pervan |
| 2020/0102756 | A1 | 4/2020 | Pervan |
| 2020/0109569 | A1 | 4/2020 | Pervan |
| 2020/0149289 | A1 | 5/2020 | Pervan |
| 2020/0173175 | A1 | 6/2020 | Pervan |
| 2020/0224430 | A1 | 7/2020 | Ylikangas et al. |
| 2020/0263437 | A1 | 8/2020 | Pervan |
| 2020/0284045 | A1 | 9/2020 | Kell |
| 2020/0318667 | A1 | 10/2020 | Derelöv |

FOREIGN PATENT DOCUMENTS

| | | | |
|---|---|---|---|
| DE | 197 52 286 | A1 | 5/1999 |
| DE | 202 05 774 | U1 | 8/2002 |
| DE | 203 20 799 | U1 | 4/2005 |
| DE | 10 2004 055 851 | A1 | 7/2005 |
| DE | 10 2004 062 648 | | 7/2006 |
| DE | 10 2006 057 491 | A1 | 6/2008 |
| EP | 0 974 713 | A1 | 1/2000 |
| EP | 1 420 125 | A2 | 5/2004 |
| EP | 1 650 375 | A1 | 4/2006 |
| EP | 1 674 223 | A1 | 6/2006 |
| EP | 1 650 375 | A8 | 9/2006 |
| EP | 1 674 223 | B1 | 7/2008 |
| EP | 2 395 179 | A2 | 12/2011 |
| EP | 2 276 614 | B1 | 9/2012 |
| EP | 2 689 904 | A1 | 1/2014 |
| EP | 2 732 923 | A2 | 5/2014 |
| EP | 2 774 735 | A1 | 9/2014 |
| EP | 2 732 923 | B1 | 1/2018 |
| EP | 3 354 909 | A1 | 8/2018 |
| EP | 3 478 901 | A1 | 5/2019 |
| EP | 2 774 735 | B1 | 10/2019 |
| GB | 340629 | | 10/1925 |
| GB | 376352 | | 7/1932 |
| GB | 1171337 | | 11/1969 |
| SE | 529 076 | C2 | 4/2007 |
| WO | WO 94/26999 | A1 | 11/1994 |
| WO | WO 96/27721 | A1 | 9/1996 |
| WO | WO 97/47834 | A1 | 12/1997 |
| WO | WO 00/20705 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/51732 | A1 | 7/2001 |
| WO | WO 01/75247 | A1 | 10/2001 |
| WO | WO 01/98604 | A1 | 12/2001 |
| WO | WO 03/016654 | A1 | 2/2003 |
| WO | WO 03/044303 | A1 | 5/2003 |
| WO | WO 03/063234 | A1 | 10/2003 |
| WO | WO 03/087497 | A1 | 10/2003 |
| WO | WO 2004/016877 | A1 | 2/2004 |
| WO | WO 2004/020764 | A1 | 3/2004 |
| WO | WO 2004/065765 | A1 | 10/2004 |
| WO | WO 2005/054599 | A1 | 6/2005 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/015669 | A3 | 2/2007 |
| WO | WO 20071079845 | A1 | 7/2007 |
| WO | WO 2007/109787 | A2 | 9/2007 |
| WO | WO 2008/017301 | A2 | 2/2008 |
| WO | WO 2008/017301 | A3 | 2/2008 |
| WO | WO 2009/116926 | A1 | 9/2009 |
| WO | WO 2009/124517 | A1 | 10/2009 |
| WO | WO 2010/001262 | A2 | 1/2010 |
| WO | WO 2013/037904 | A2 | 3/2010 |
| WO | WO 2010/087752 | A1 | 8/2010 |
| WO | WO 2012/154113 | A1 | 11/2012 |
| WO | WO 2013/025164 | A1 | 2/2013 |
| WO | WO 2013/025165 | A1 | 2/2013 |
| WO | WO 2015/038059 | A1 | 3/2015 |
| WO | WO 2015/105451 | A1 | 7/2015 |
| WO | WO 2015/133768 | A1 | 9/2015 |
| WO | WO 2017/135874 | A1 | 8/2017 |

OTHER PUBLICATIONS

International Search Report and Written Opinion issued in PCT/SE2017/050711, dated Sep. 19, 2017, 12 pages, SA/SE, Patent-och registreringsverket, Stockholm, SE.

U.S. Appl. No. 16/839,657, Peter Derelöv, filed Apr. 3, 2020.

(56) References Cited

OTHER PUBLICATIONS

U.S. Appl. No. 16/839,657, filed Apr. 3, 2020, Derelöv.
Extended European Search Report dated Apr. 2, 2020 in EP 17820657.9, European Patent Office, Munich, DE, 4 pages.
Derelöv, Peter, U.S. Appl. No. 16/839,657, entitled "Automated Assembly," filed in the U.S. Patent and Trademark Office Apr. 3, 2020.
U.S. Appl. No. 17/060,325, Jonas Fransson, filed Oct. 1, 2020.
U.S. Appl. No. 17/060,325, Fransson—See Information Below.
International Search Report and Written Opinion issued in PCT/EP2020/059600, dated Jul. 7, 2020, 14 pages, ISA/SE, European Patent Office, Rijswijk, NL.
Extended European Search Report dated Oct. 15, 2019 in EP 19167502.4, European Patent Office, Munich, DE, 6 pages.
Fransson, Jonas, U.S. Appl. No. 17/060,325, entitled "Method and Device for Inserting a Tongue," filed in the U.S. Patent and Trademark Office Oct. 1, 2020.
U.S. Appl. No. 15/635,379, Fredrik Myllykangas and Jonas Fransson, filed Jun. 28, 2017 (Cited herein as US Patent Application Publication No. 2018/0001509 A1 of Jan. 4, 2018).
U.S. Appl. No. 15/635,532, Jonas Fransson, filed Jun. 28, 2017 (Cited herein as US Patent Application Publication No. 2018/0001510 A1 of Jan. 4, 2018).
U.S. Appl. No. 15/635,619, Andreas Blomgren and Jonas Fransson, filed Jun. 28, 2017 (Cited herein as US Patent Application Publication No. 2018/0001573 A1 of Jan. 4, 2018).
International Search Report and Written Opinion issued in PCT/SE2017/050718, dated Sep. 15, 2017, 11 pages, ISA/SE, Patent-och registreringsverket, Stockholm, SE.
International Search Report and Written Opinion issued in PCT/SE2017/050716, dated Sep. 15, 2017, 10 pages, ISA/SE, Patent-och registreringsverket, Stockholm, SE.
International Search Report and Written Opinion issued in PCT/SE2017/050717, dated Sep. 19, 2017, 13 pages, ISA/SE, Patent-och registreringsverket, Stockholm, SE.
International Search Report and Written Opinion issued in PCT/SE2017/051305, dated Mar. 5, 2018, 12 pages, ISA/SE, Patent-och registreringsverket, Stockholm, SE.
Extended European Search Report dated Jan. 2, 2020 in EP 17820655.3, European Patent Office, Munich, DE, 14 pages.
Extended European Search Report dated Dec. 9, 2019 in EP 17820656.1, European Patent Office, Munich, DE, 10 pages.
Extended European Search Report dated Jan. 30, 2020 in EP 17820652.0, European Patent Office, Munich, DE, 10 pages.
Extended European Search Report dated Jul. 22, 2020 in EP 17883594.8, European Patent Office, Munich, DE, 5 pages.

* cited by examiner

DEVICE FOR INSERTING A TONGUE

CROSS REFERENCE TO RELATED APPLICATIONS

The present application claims the benefit of Swedish Application No. 1651731-0, filed on Dec. 22, 2016. The entire contents of Swedish Application No. 1651731-0 are hereby incorporated herein by reference in their entirety.

TECHNICAL FIELD

Embodiments of the present invention relate to methods and devices for inserting a tongue into an insertion groove in a panel. The panel is configured to be arranged and locked perpendicular to an adjacent panel by a locking device comprising the tongue. The panels may be assembled and locked together to obtain a furniture product, such as a bookshelf, a cupboard, a wardrobe, a box, a drawer, or a furniture component.

BACKGROUND

A conventional furniture product may be assembled by a plurality of elements or panels. The panels may be assembled with a mechanical locking device, such as disclosed in, for example, WO 2012/154113 A1. The product comprises a first panel connected perpendicularly to a second panel by a mechanical locking device comprising, an edge tongue at the first panel, an edge groove at the second panel and a flexible tongue in an insertion groove.

WO 2015/038059 discloses a product assembled by a plurality of panels that are locked by mechanical locking devices comprising a flexible tongue in an insertion groove.

The locking devices of the panels are generally produced in a production line by a continuous production process, comprising a number of milling tools. The edge groove and the insertion groove may extend contiguously from a front edge to a back edge of the panel. The edge groove is preferably covered at the front edge by a decorative layer. The edge groove and the insertion groove may also end before the front edge and/or the back edge as disclosed in, e.g., SE 1650135-5 and WO 2017/135874.

Embodiments of the present invention address a need to provide an improved device for inserting a tongue into an insertion groove in a panel.

SUMMARY

Accordingly, embodiments of the present invention preferably seek to mitigate, alleviate or eliminate one or more deficiencies, disadvantages or issues in the art, such as the above-identified, singly or in any combination by providing a device for inserting a tongue in an insertion groove of a panel. The device is preferably handheld or configured to be attached to an assembling table.

A further object of embodiments of the invention is to provide a device with great flexibility which is suitable for short series production.

At least some of these and other objects and advantages that will be apparent from the description have been achieved by an aspect of the invention including a handheld device for inserting a tongue into an insertion groove in a panel, such as a furniture panel or a floor panel. The device comprises a first part comprising a power unit configured for driving a puncher. The device comprises a second part, which is connected to the first part. The second part comprises the displaceable puncher and a guiding device which is configured to guide the displaceable puncher, and the tongue. An outer edge of the second part comprises a first positioning element and a second positioning element. The first positioning element and the second positioning element are configured to be positioned at least partly in the insertion groove during an insertion of a tongue into the insertion groove. The displaceable puncher is configured to displace a tongue from the handheld device to an inserted position in the insertion groove.

The second part is preferably configured such that the tongue is displaceable between the first positioning element and the second positioning element.

An inner surface of the first positioning element is preferably positioned at a distance from an inner surface of the second positioning element. The distance is preferably essentially equal to a longitudinal length of the tongue.

An outer width of the puncher, which is configured to be displaced between the first positioning element and the second positioning element, may be essentially equal to a longitudinal length of the tongue.

The tongue may be of an elongated shape, wherein a longitudinal direction of the tongue is perpendicular to a displacement direction of the displaceable puncher.

The insertion groove may be of an elongated shape, wherein a longitudinal direction of the insertion groove is parallel to an edge of the panel.

The tongue may be of an elongated shape, wherein a longitudinal direction of the tongue, in the inserted position, is parallel with the longitudinal direction of the insertion groove.

The device may comprise an attachment device and the device may be configured to be attached to a holding fixture or an assembling table by the attachment device.

The second part may comprise a magazine for two or more of said tongue.

The magazine may be configured for storing a second of said tongue above a first of said tongue, wherein the magazine extends essentially perpendicular to the second direction.

The magazine may be configured such that charging of a tongue into the magazine in the correct orientation is facilitated. An embodiment may comprise a top plate with an opening which is adapted to an outer shape of the tongue, such that the tongue may only be charged in a correct position.

The device may comprise a handle, preferably at the first part.

The first part may comprise a trigger for activating a stroke of the displaceable puncher.

The handle may comprise a trigger for activating a stroke of the displaceable puncher.

The groove is of an elongated shape and extends with a length direction along the upper surface of the panel.

The tongue may be of an elongated shape and a length direction of the tongue may be parallel with the length direction of the insertion groove.

The tongue may be of an elongated shape and a length direction of the tongue may be perpendicular to a displacement direction of the displaceable puncher.

The tongue may be of an elongated shape and may comprise a first long edge and a second-long edge.

The tongue may be a flexible tongue and made of, e.g., a polymer and preferably comprising a reinforcement material, such as a fibre, e.g., glasfiber.

The tongue may comprise a bendable part at the first long edge and preferably a groove adjacent the bendable part. The bendable part may be configured to be pushed into the groove adjacent the bendable part. The tongue may comprise several of said bendable part and preferably several of said groove.

The tongue may comprise a polymer material and is preferably produced by injection moulding.

The edge groove and the insertion groove may extend continuously from a front edge to a back edge of the panel.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DESCRIPTION OF EMBODIMENTS

Figure 1:
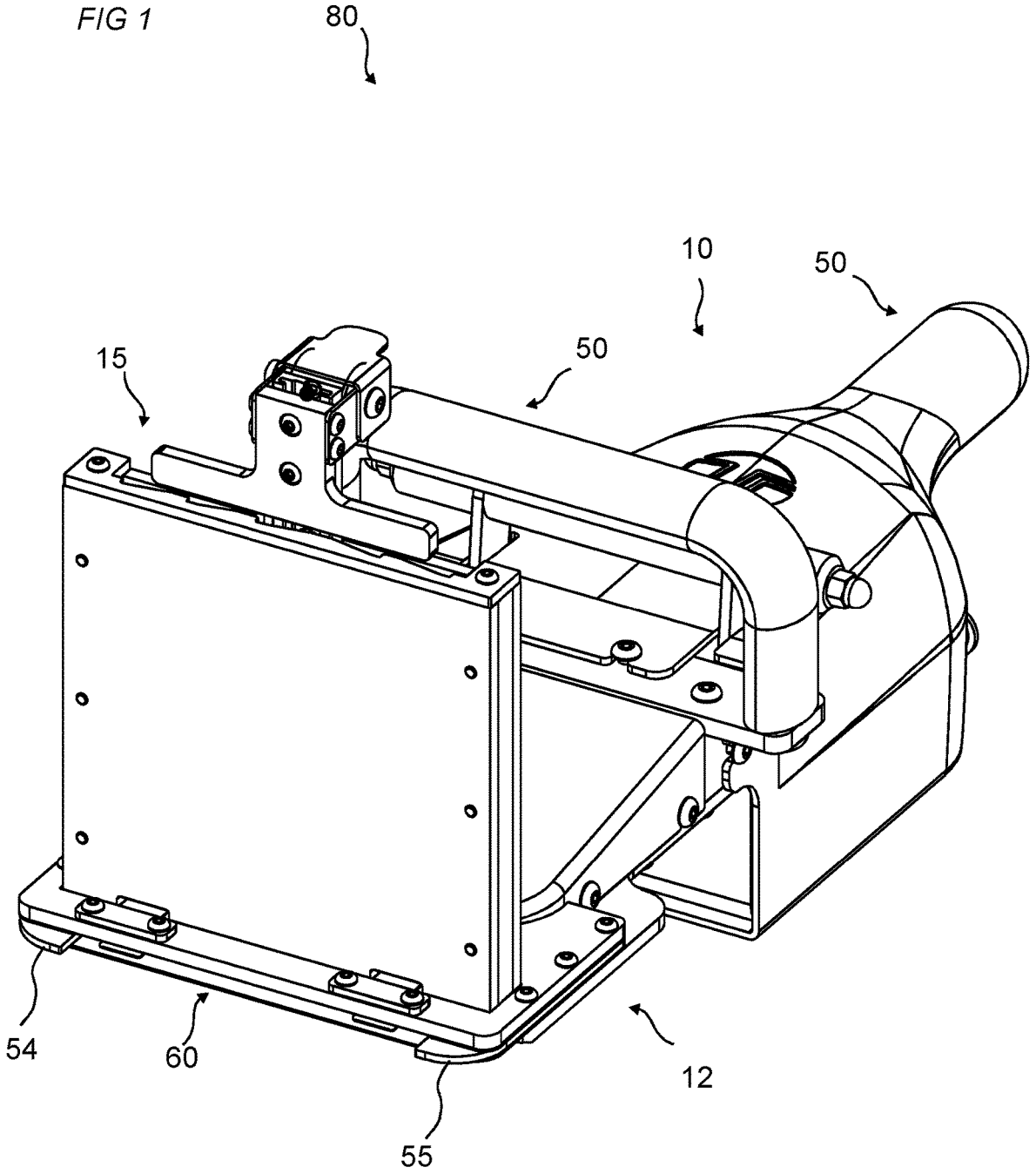
FIG. 1 shows in a 3D-view an embodiment of the handheld device according to an embodiment of the invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Embodiments of the handheld device are shown in FIG. 1 to FIG. 6B that may improve an insertion of a tongue into an insertion groove of a panel.

Figure 2:
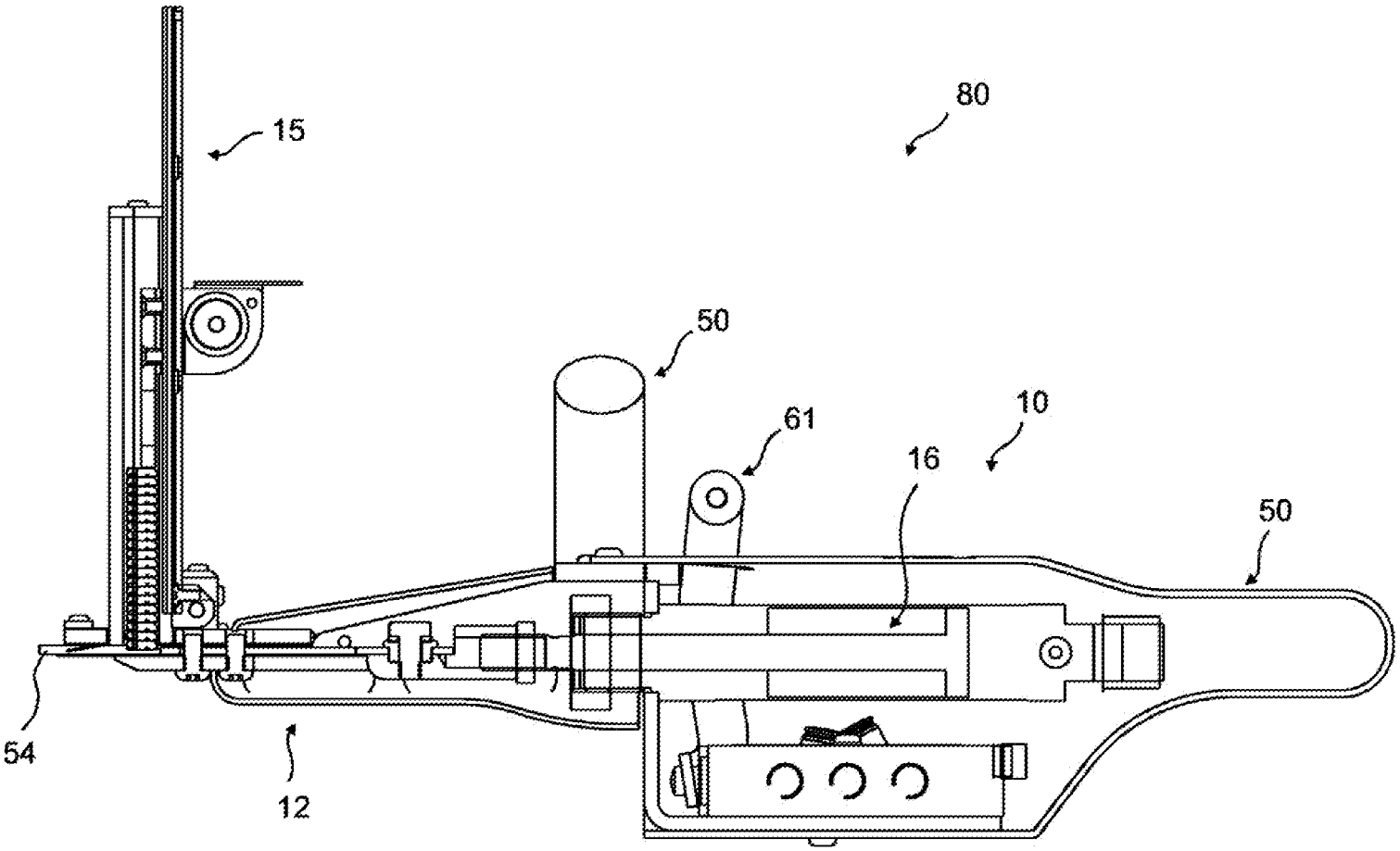
FIG. 2 shows a crosscut in a side view of an embodiment of the handheld device according to an embodiment of the invention.

FIG. 1 shows in a 3D-view an embodiment of the handheld device and FIG. 2 shows a crosscut of the embodiment in a side view. The embodiment comprises a first part 10 comprising a power unit 16 which is configured for driving a puncher 14 and a second part 12, which is connected to the first part 10.

Figure 3A:
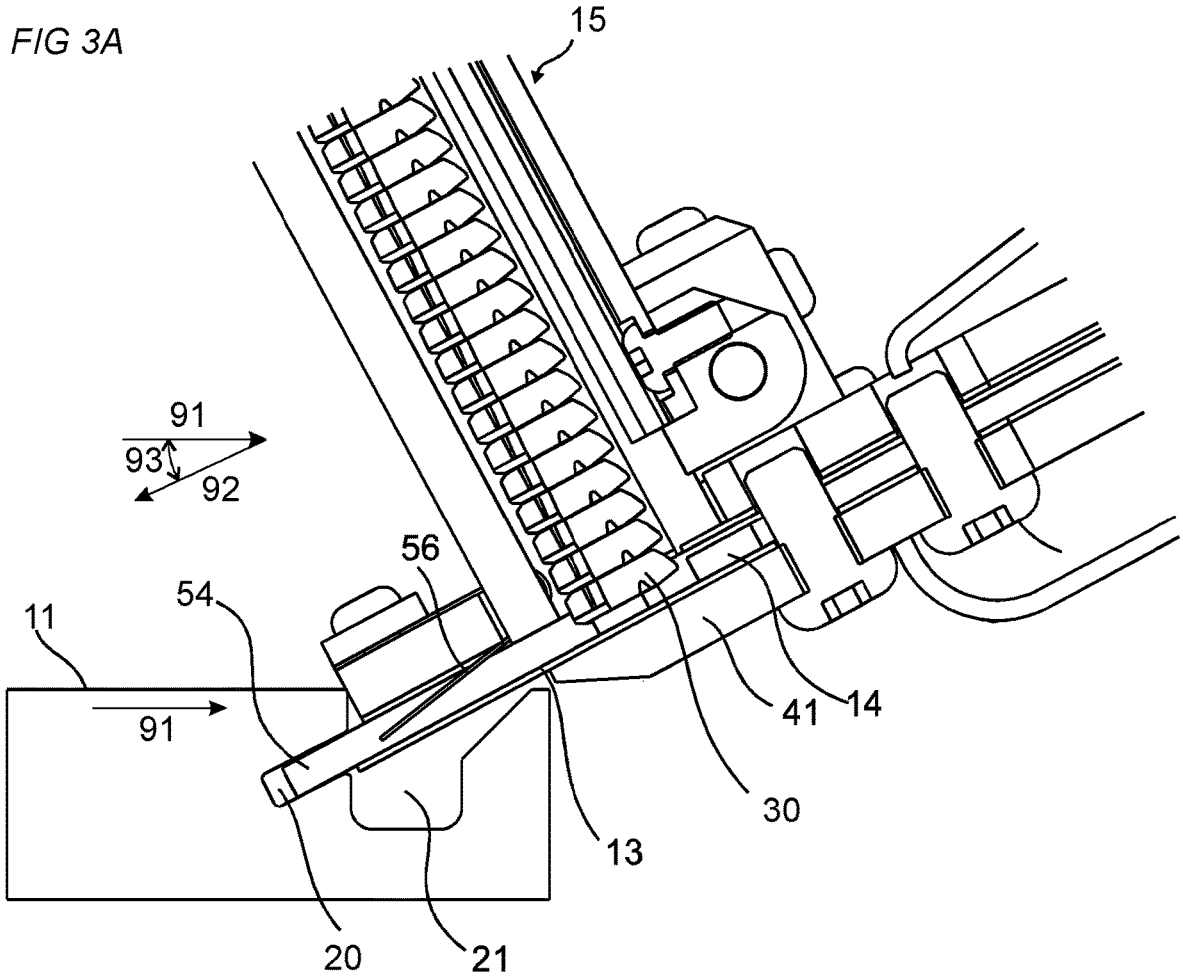
FIGS. 3A-3B show an enlargement of parts of the embodiment of the device shown in FIG. 2 according to an embodiment of the invention.

FIG. 3A shows that the second part comprises the displaceable puncher 14 and a guiding device 13 which is configured to guide the displaceable puncher 14 and the tongue 30. An outer edge 60 of the second part 12 comprises a first positioning element 54 and a second positioning element 55. The first positioning element 54 and the second positioning element 55 are configured to be positioned at least partly in the insertion groove 20 during an insertion of the tongue into the insertion groove 20, the displaceable puncher 14 is configured to displace the tongue 30 from the handheld device to an inserted position in the insertion groove 20.

Figure 3B:
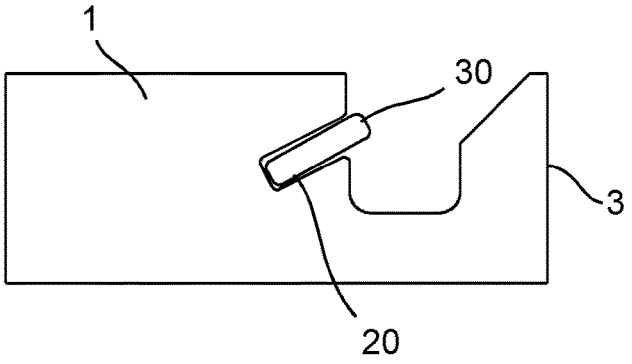
Figure 4:
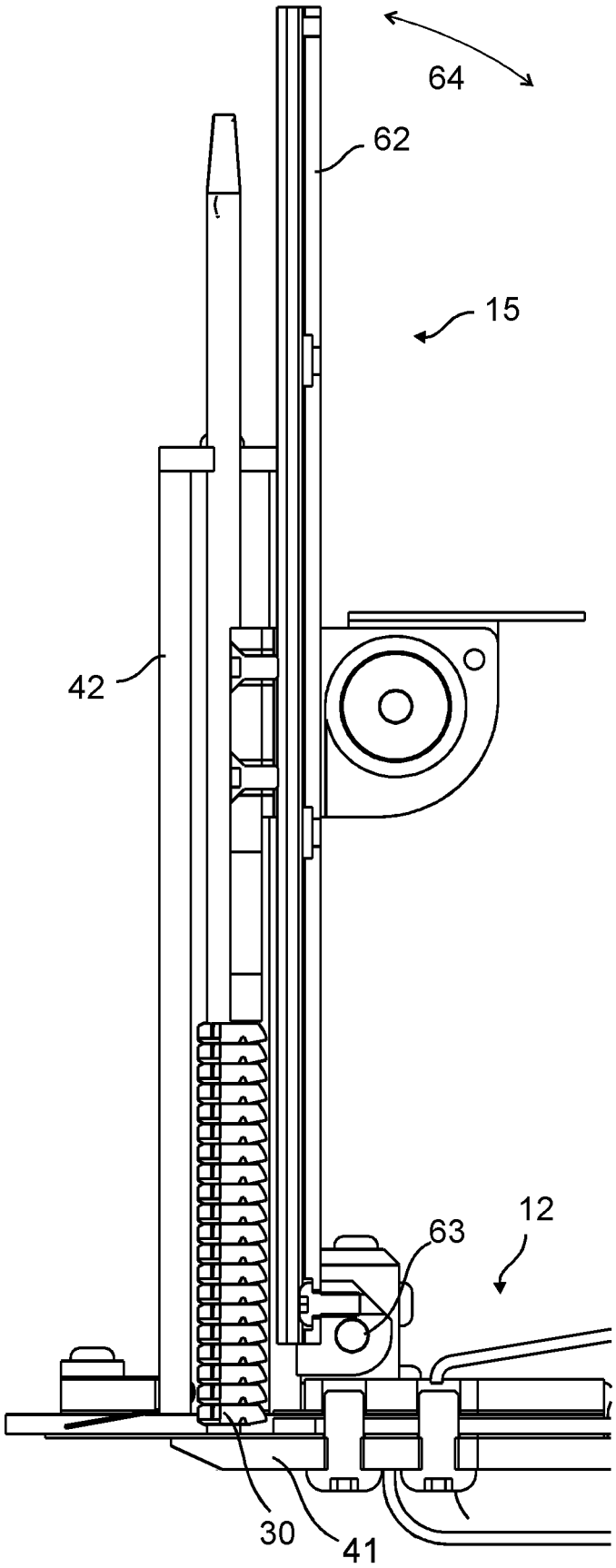
FIG. 4 shows an enlargement of parts of the embodiment of the device shown in FIG. 2 according to an embodiment of the invention.

FIG. 3A shows an enlargement of some of the parts shown in FIG. 2 during an insertion of the tongue 30 into the insertion groove 20. FIG. 3B shows the tongue 30 in the inserted position in the insertion groove 20 at an edge 3 of the panel 1.

The second part may be configured such that the tongue 30 is displaceable between the first positioning element 54 and the second positioning element 55.

The panel 1 may have an upper surface 11 extending in a first direction 91 and a depth direction of the insertion groove may extend in a second direction 92 at an angle 93 to the first direction 91. The angle 93 may be in the range of about 0° to about 90°, preferably in the range of about 10° to about 45°, or is about 25°.

The handheld device is during the insertion preferably arranged in a position in which the guiding device extends in a direction parallel to the depth direction of the insertion groove.

The second part 12 may comprise a magazine 15 for two or more of said tongues 30. The magazine may be configured for storing a second of said tongue above a first said tongue and the magazine 15 may be extending essentially perpendicular to a displacement direction of the displaceable puncher 14.

The second part may comprise a lower structural part 41. The magazine 15 may extend essentially perpendicular to the lower structural part 41. An embodiment of the magazine is shown in a crosscut side-view in FIG. 4. The magazine comprises a magazine frame 42 and a feeding device 62 configured to feed tongues arranged in the magazine frame 42. The feeding device is attached pivotable 64 to a lower part by a hinge 63 in order to facilitate charging of tongues in the magazine frame 42.

The guiding device 13 may comprise a flexible guiding element 56 at an outer part of the guiding device. The flexible guiding element is configured to guide the tongue 30 into the insertion groove 20.

The insertion groove 20 may be of an elongated shape with a longitudinal direction parallel to the edge 3 of the panel.

The tongue 30 may be of an elongated shape and a length direction of the tongue may be parallel with the longitudinal direction of the insertion groove 20.

The tongue 30 may be of an elongated shape and a length direction of the tongue may be perpendicular to a displacement direction of the displaceable puncher 14.

Figure 5A:
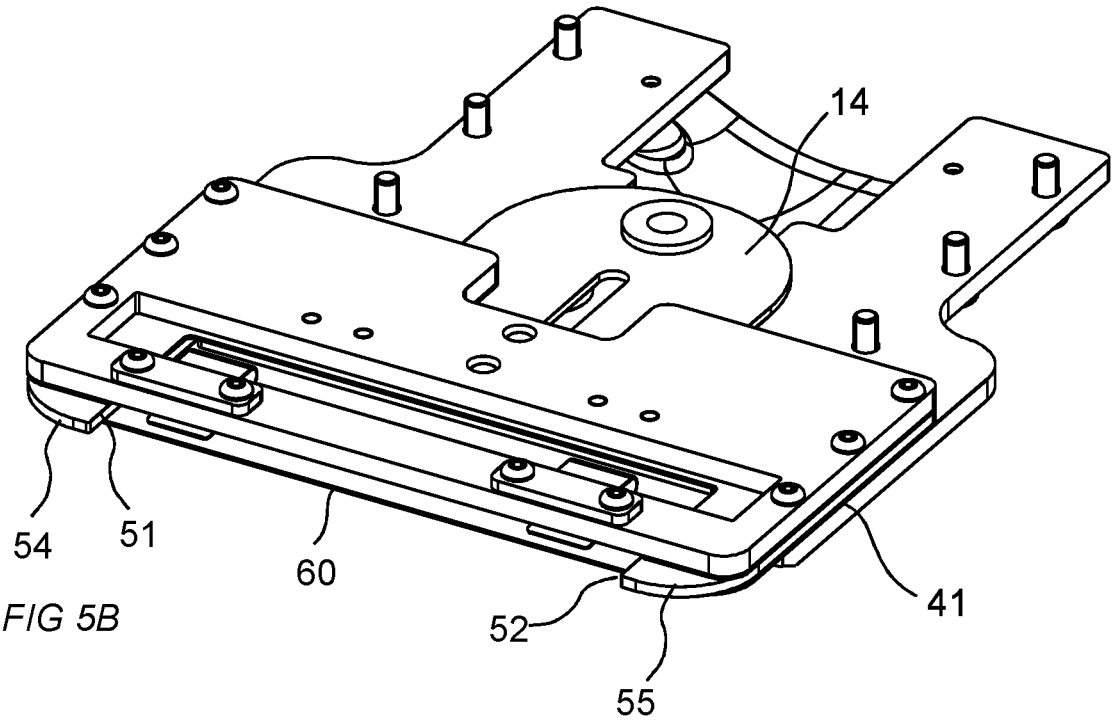
FIGS. 5A-5B shows in a 3D-view embodiments of parts of an embodiment of the second part.

A lower part of an embodiment of the second part is shown in FIG. 5A in a 3D-view. The embodiment shows that an inner surface 51 of the first positioning element 54 is preferably positioned at a distance from an inner surface 52 of the second positioning element 55. The distance is preferably equal to a longitudinal length of the tongue. The second part 12 comprises a lower structural part 41.

An outer width of the puncher, which is configured to be displaced between the first positioning element and the second positioning element, may be essentially equal to a longitudinal length of the tongue.

Figure 5B:
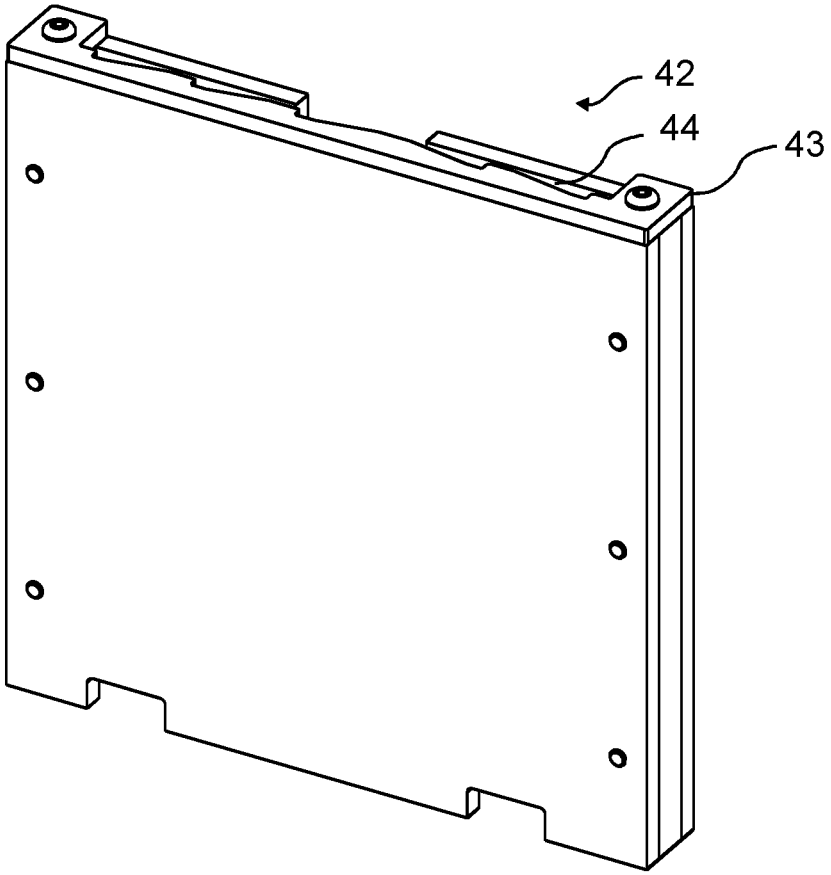

FIG. 5B shows in a 3D-view an embodiment of the magazine frame 42. The magazine may be attached to the lower part shown in FIG. 5A. The frame is configured for charging of tongues through an opening at upper part of the magazine frame.

The magazine 15 may be configured such that charging of a tongue into the magazine frame 42 in the correct orientation is facilitated. An embodiment of the magazine frame may comprise a top plate 43 with a charging opening 44 which is adapted to an outer shape of the tongue 30, such that the tongue may only be charged in a correct position.

Figure 6A:
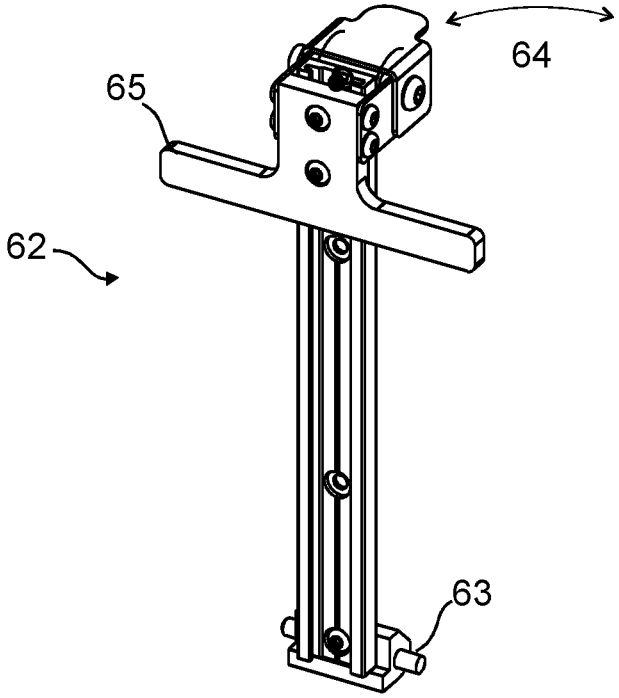
FIGS. 6A-6B shows in a 3D-view embodiments of parts of an embodiment of the first part and the second part, respectively.

FIG. 6A shows in a 3D-view a feeding device 62 configured to feed tongues arranged in the magazine frame 42 shown in FIG. 5B. The feeding device comprises a displaceable element 65 which is configured to displace the tongues towards the displaceable puncher 14. The displaceable element may be spring-loaded. The feeding device may be attached pivotable 64 to the lower part shown in FIG. 5A by a hinge 63 in order to facilitate charging of tongues in the magazine frame 42.

The feeding device 62 may be pivoted away 64 from a charging opening 44 of the magazine frame 44 before a tongue is charged into the magazine frame.

Figure 6B:
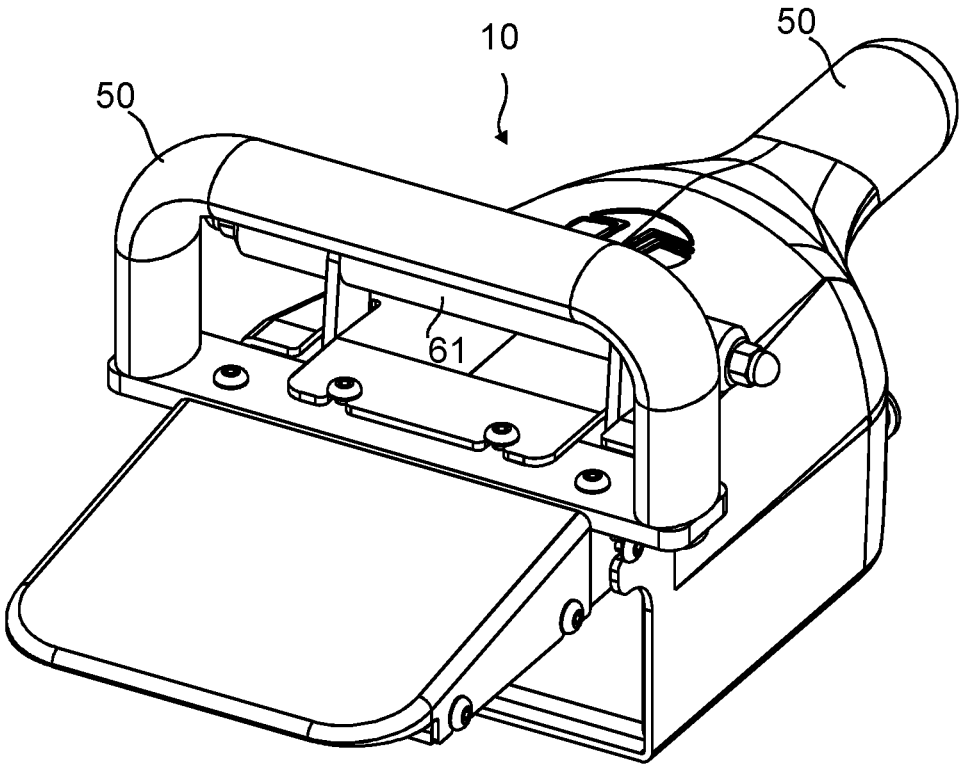

A tongue set comprising two or more of said tongue 30 may be connected to each other by a releasable connection, such as a strip, a pin or a welding. The releasable connection may be removed from the tongue set when the tongue set is charged into the magazine frame 42. The releasable connection is preferably configured such that a front tongue of the tongue set is released when the front tongue is displaced by the displaceable puncher 14. FIG. 6B shows, in a 3D-view, an embodiment of the first part 10. The embodiment comprises a handle 50 at a back part, another handle 50' at a front part and a trigger 61. The first part may be attached to the lower structural part 41 of the second part shown in FIG. 5A.

Embodiments may comprise exchangeable embodiments of the second part, wherein each embodiment of the second part is configured for a specific tongue embodiment. A first exchangeable embodiment of the second part may be configured for a tongue with a first longitudinal length and a second exchangeable embodiment of the second part is configured for a tongue with a second longitudinal length. The second longitudinal length may be shorter or longer that the first longitudinal length.

Figure 7A:
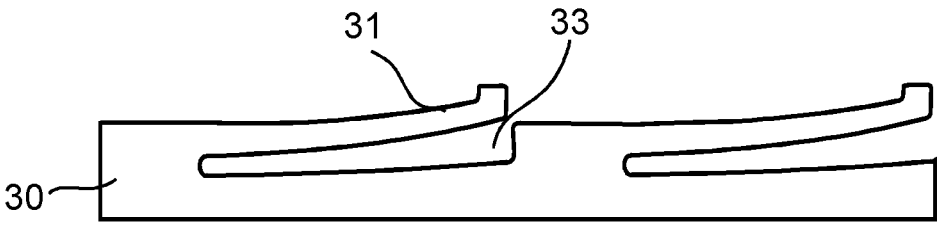
FIGS. 7A-7D show embodiments of a tongue according to embodiments of the invention.
Figure 7B:
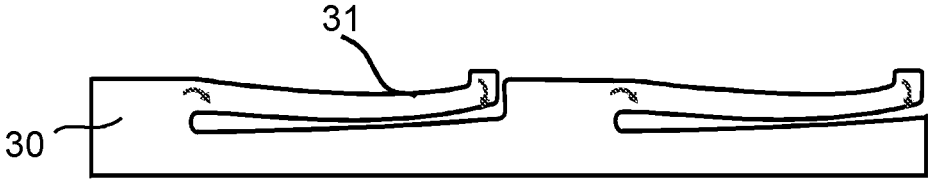
Figure 7C:
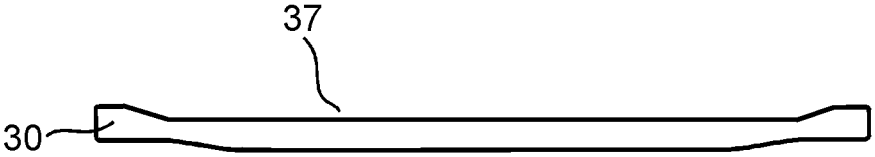
Figure 7D:
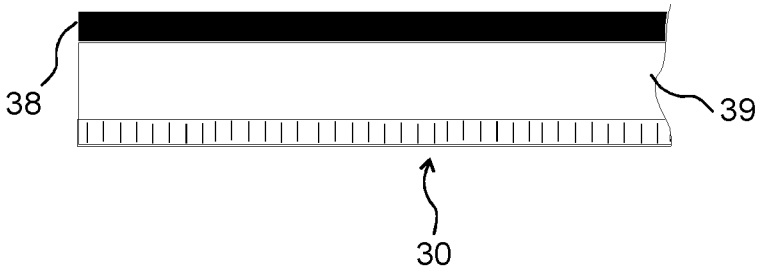

Embodiments of the tongue 30, which may be displaceable in an insertion groove 20 as shown in FIGS. 9A-9D, are shown in FIGS. 7A-7D. A first embodiment of the tongue, which is shown in FIGS. 7A-7B, comprises bendable protruding parts 31 at a first long edge of the tongue. The first embodiment is shown in a relaxed state in FIG. 7A and in a compressed state in FIG. 7B. A second long edge of the tongue is preferably essentially straight. The first embodiment may be inserted into the insertion groove with the bendable protruding parts facing towards a bottom of the insertion groove and the second edge extending beyond an opening of the insertion groove. A second embodiment of the tongue, which is shown in FIG. 7C in a relaxed state, is of an elongated shape and flexible. The second embodiment comprises a recess 37 at a first long edge of the tongue and a second edge which is essentially straight. The recess is decreased in a compressed state of the second embodiment. The second embodiment may be inserted into the insertion groove with the recess 37 facing towards a bottom of the insertion groove and the second edge extending beyond an opening of the insertion groove. A third embodiment of the tongue, which is shown in FIG. 7D, comprises a first part 38, which is flexible and configured to be compressed, and a second part which is rigid 39. The first part may be arranged in the insertion groove and the second part may partly extend beyond an opening of the insertion groove.

The tongue may be configured as any of the embodiments of the displaceable tongue disclosed in, e.g., WO 2006/043893 and WO 2007/015669, the entire contents of which are hereby expressly incorporated by reference.

The tongue may be flexible and made of, e.g., a polymer and preferably comprising a reinforcement material, such as a fibre, e.g., glasfiber.

Figure 8A:
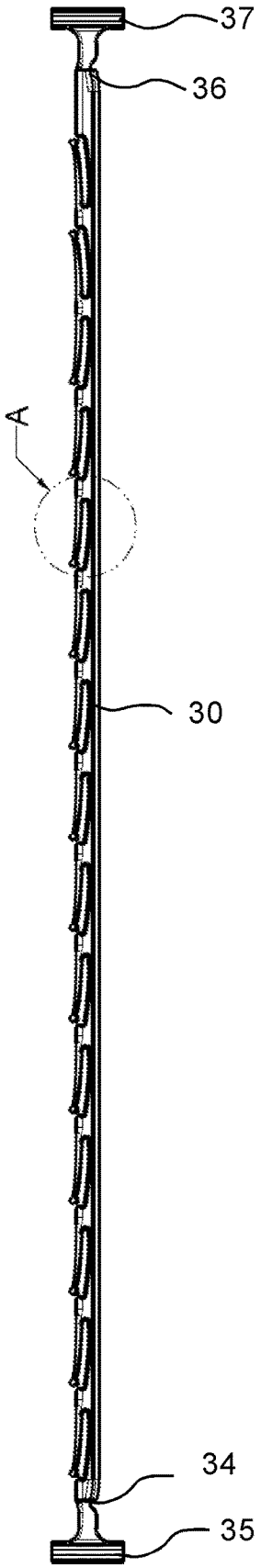
FIGS. 8A-8D show an embodiment of a tongue according to an embodiment of the invention.
Figure 8B:
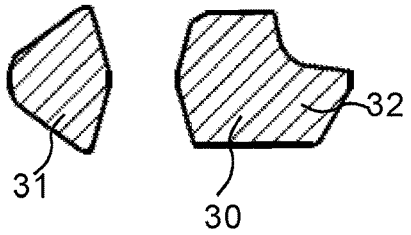
Figure 8C:
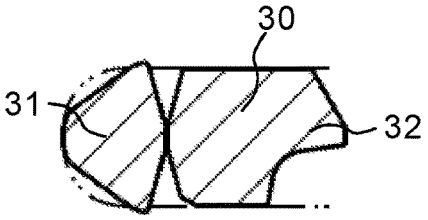
Figure 8D:
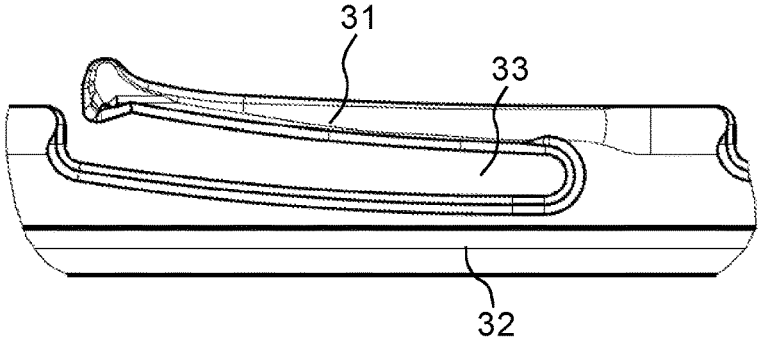

Another embodiment of the tongue 30 is shown in FIGS. 8A-8D. The tongue is of an elongated shape and comprises a first short edge 34, an opposite second short edge 36, first long edge and a second long edge 32. FIG. 8D shows an enlargement of the encircled area A indicated in FIG. 8A. The tongue comprises several bendable parts 31 at the first long edge and a groove 33 at each bendable part 31. The tongue comprises a polymer material and is preferably produced by injection moulding. The bendable part 31 is configured to be pushed into the groove 33 in a compressed state of the tongue.

FIG. 8A shows an embodiment of tongue which is connected to several tongues (not shown) in a tongue blank by a first rail 35 at the first short edge 34 and by a second rail 37 at the second short edge 36. The first rail and the second rail extend in a length direction perpendicular to the tongue. The tongue may be connected to the first rail and/or the second rail, which may be casting gates, by a first and a second casting gate, respectively. The tongues are separated from the first and/or the second rail before a stacking in magazine configured to be attached to the device.

FIG. 8B and FIG. 8C show the tongue 30 in a cross cut view. The tongue is in FIG. 8B in a relaxed state an in FIG. 8C in a compressed state. A distance between an outer part of the bendable part 31 and the second long edge 32 is shorter in the compressed state compared to in the relaxed state.

The tongue is preferably configured to be inserted into an insertion groove of a panel for locking the panel to an adjacent panel.

FIGS. 9A-9D shows embodiments of the panel 1, each comprising an embodiment of the tongue 30 inserted in an embodiment of the insertion groove 20, connected to an adjacent panel 2. The embodiments of the panel shown in FIGS. 9A-9D may be furniture panels. The embodiment of the panel shown in FIG. 9C may also be a floor panel.

Figure 9A:
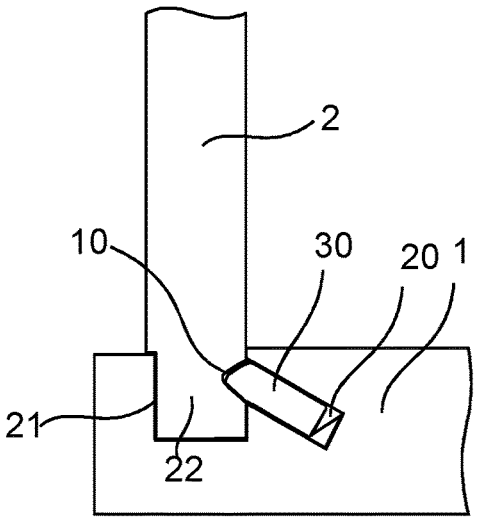
FIGS. 9A-9D show embodiments of the panel according to embodiments of the invention.

FIG. 9A shows the panel 1 arranged perpendicular to an adjacent panel 2 and locked to the adjacent panel in a first direction and in a second direction, which is perpendicular to the first direction. The panel comprising an edge groove 21 at an upper surface of the panel. The edge groove 21 is of a longitudinal shape and extends along an edge of the panel 1. The edge groove may comprise said insertion groove 20, which extends along the edge groove, comprising said tongue 30. The adjacent panel comprises an edge tongue 22 which comprises a tongue groove 10 extending along an edge of the adjacent panel. The tongue 30 is configured to cooperate with the tongue groove 10 for locking together the panel 1 with the adjacent panel 2 in the first direction. The edge tongue 22 is configured to cooperate with the edge groove 21 for locking together the panel 1 with the adjacent panel 2 in the second direction.

Figure 9B:
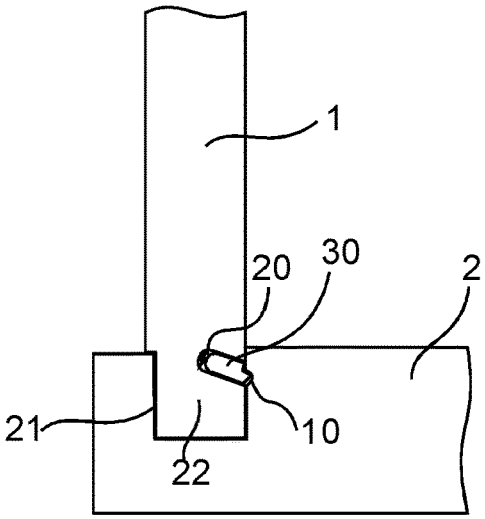

FIG. 9B shows the panel 1 arranged perpendicular to an adjacent panel 2 and locked to the adjacent panel in a first direction and in a second direction, which is perpendicular to the first direction. The adjacent panel comprising an edge groove 21 at an upper surface of the adjacent panel. The edge groove 21 is of a longitudinal shape and extends along an edge of the adjacent panel 1. The edge groove comprises a tongue groove 10. The panel comprises an edge tongue 22 which comprises said insertion groove 20 comprising said tongue 30. The insertion groove extends along the edge tongue. The tongue 30 is configured to cooperate with the tongue groove 10 for locking together the panel 1 with the adjacent panel 2 in the first direction. The edge tongue 22 is configured to cooperate with the edge groove 21 for locking together the panel 1 with the adjacent panel 2 in the second direction.

Figure 9C:
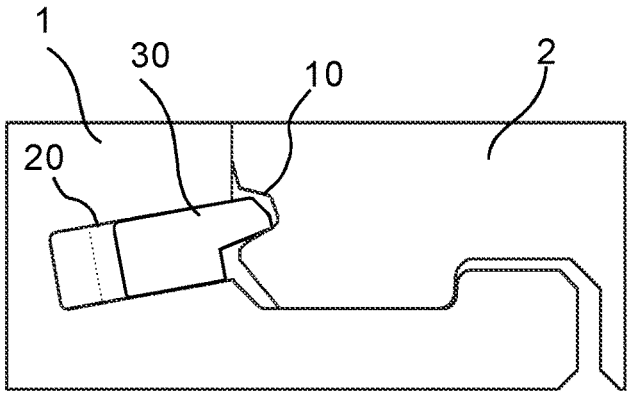

FIG. 9C shows the panel 1 arranged parallel to an adjacent panel 2 and locked to the adjacent panel in a first direction and in a second direction, which is perpendicular to the first direction. The panel comprising said insertion groove 20 which extends along an edge of the panel. The edge comprises a strip protruding from the edge and the strip comprises an upwardly protruding locking element. The adjacent panel 2 comprises a tongue groove 10 extending along an adjacent edge of the adjacent panel 2. The adjacent edge comprises a locking groove with an opening facing downwards. The tongue 30 is configured to cooperate with the tongue groove 10 for locking the panel to the adjacent panel in a first direction and the locking element is configured to cooperate with the locking groove for locking the panel to the adjacent panel in the second direction. An embodiment of the said first and second panel comprises the insertion groove 20 at the adjacent edge of the adjacent panel and the tongue groove 10 at the edge of the panel.

Figure 9D:
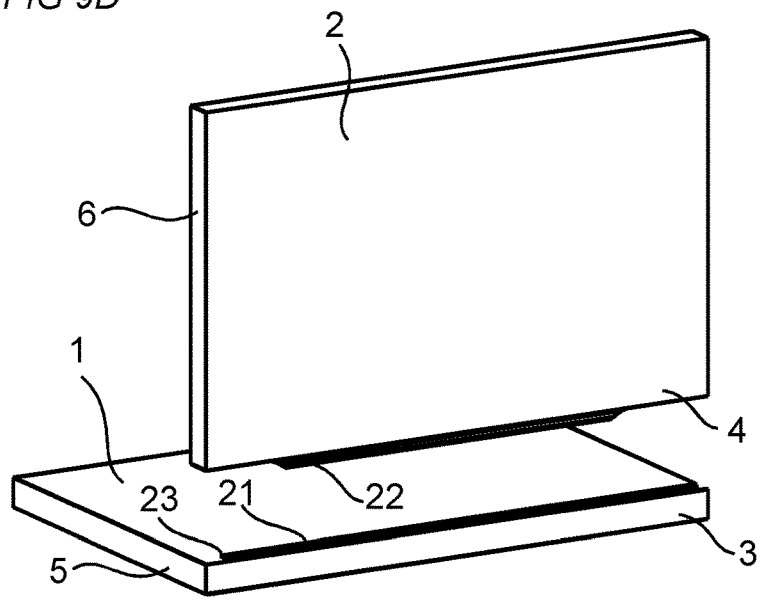

FIG. 9D shows an embodiment of the panel and the adjacent panel shown in FIG. 8A in a 3D-view. The edge tongue 22 extends along the edge 4 of the adjacent panel and ends before an adjacent edge 6 of the adjacent panel 2. The edge groove 21 extends along the edge 3 of the panel 1 and ends at a side wall 23 before an adjacent edge of the 5 of the panel 1.

A core material of embodiments of the panel and the adjacent panel described above may comprises a wood fibre based board, such as a HDF, MDF, plywood, solid wood or particleboard, or a reinforced plastic board or a wood fibre composite board. The core may be provided with a decorative layer.

Embodiments

1. A handheld device (80) for inserting a tongue (30) into an insertion groove (20) in a panel (1) characterized in that the handheld device comprises a first part (10) comprising a power unit (16) which is configured for driving a puncher (14), that the handheld device comprises a second part (12), which is connected to the first part (10), that the second part comprises the displaceable puncher (14) and a guiding device (13) which is configured to guide the displaceable puncher (14) and the tongue (30), that an outer edge (60) of the second part (12) comprises a first positioning element (54) and a second positioning element (55), that the first positioning element (54) and the second positioning element (55) are configured to be positioned at least partly in the insertion groove (20) during an insertion of the tongue into the insertion groove, that the displaceable puncher (14) is configured to displace the tongue (30) from the handheld device to an inserted position in the insertion groove (20).

2. The handheld device as in embodiment 1, wherein the second part is configured such that the tongue (30) is displaceable between the first positioning element (54) and the second positioning element (55).
3. The handheld device as in embodiment 1 or 2, wherein an inner surface (51) of the first positioning element (54) is positioned at a distance from an inner surface (52) of the second positioning element (55).
4. The handheld device as in any one of the embodiments 1-3, wherein the second part (12) comprises a magazine (15) for two or more of said tongue (30).
5. The handheld device as in embodiment 4, wherein the magazine (15) is configured for storing a second of said tongue above a first said tongue.
6. The handheld device as in any one of the embodiments 1-5, wherein the tongue (30) is of an elongated shape, wherein a longitudinal direction of the tongue is perpendicular to a displacement direction of the displaceable puncher (14).
7. The handheld device as in any one of the embodiments 1-6, wherein the insertion groove is of an elongated shape, wherein a longitudinal direction of the insertion groove is parallel to an edge of the panel.
8. The handheld device as in embodiment 7, wherein the tongue (30) is of an elongated shape, wherein a longitudinal direction of the tongue, in the inserted position, is parallel with the longitudinal direction of the insertion groove (20).
9. The handheld device as in any one of the embodiments 1-8, wherein the device comprises a handle (50), preferably at the first part.
10. The handheld device as in any one of the embodiments 1-9, wherein the first part comprises a trigger (61) for activating a stroke of the displaceable puncher (14).

The invention claimed is:

1. A handheld device for inserting a tongue into an insertion groove in a panel, wherein the handheld device comprises a first part comprising a power unit which is configured for driving a displaceable puncher, the handheld device comprises a second part, which is connected to the first part, the second part comprises the displaceable puncher and a guiding device which is configured to guide the displaceable puncher and the tongue, an outer edge of the second part comprises a first positioning element and a second positioning element that are rigidly set with respect to each other such that, an inner surface of the first positioning element is positioned at a fixed distance from an inner surface of the second positioning element, wherein the second part is configured such that the tongue is displaceable through a space formed by the distance between the first positioning element and the second positioning element, the first positioning element and the second positioning element are configured to be positioned at least partly in the insertion groove during an insertion of the tongue into the insertion groove, the displaceable puncher is configured to displace the tongue from the handheld device to an inserted position in the insertion groove.

2. The handheld device as claimed in claim 1, wherein the second part comprises a magazine for two or more of said tongue.

3. The handheld device as claimed in claim 2, wherein the magazine is configured for storing a second of said tongue above a first said tongue.

4. The handheld device as claimed in claim 1, wherein the tongue is of an elongated shape, wherein the tongue has a longitudinal direction longer than a transverse direction, wherein the longitudinal direction of the tongue is perpendicular to a displacement direction of the displaceable puncher, wherein the transverse direction of the tongue is parallel to the displacement direction of the displaceable puncher.

5. The handheld device as claimed in claim 1, wherein the insertion groove is of an elongated shape, wherein a longitudinal direction of the insertion groove is parallel to an edge of the panel.

6. The handheld device as claimed in claim 5, wherein the tongue is of an elongated shape, wherein a longitudinal direction of the tongue, in the inserted position, is parallel with the longitudinal direction of the insertion groove.

7. The handheld device as claimed in claim 1, wherein the device comprises a handle.

8. The handheld device as claimed in claim 1, wherein the first part comprises a trigger for activating a stroke of the displaceable puncher.

* * * * *